US005500045A

United States Patent [19]

Ehinger et al.

[11] Patent Number: 5,500,045

[45] Date of Patent: Mar. 19, 1996

[54] ELECTROSTATIC SPRAYING MACHINE FOR COATING PRODUCTS

[75] Inventors: Pierre Ehinger, Faverges; Patrice Gory, Meylan, both of France

[73] Assignee: Sames S.A., Meylan, France

[21] Appl. No.: 220,675

[22] Filed: Mar. 31, 1994

[30] Foreign Application Priority Data

Apr. 1, 1993 [FR] France ..... 93 03828

[51] Int. Cl.[6] ..... B05B 7/06

[52] U.S. Cl. ..... 118/313; 118/315; 118/326; 118/621; 118/626; 118/635

[58] Field of Search ..... 118/313, 315, 118/326, 621, 626, 635; 427/424

[56] References Cited

U.S. PATENT DOCUMENTS 4,985,283 1/1991 Ogat et al. ..... 427/424
5,213,620 5/1993 Meyer ..... 118/323
5,236,504 8/1993 Frikken ..... 118/323

FOREIGN PATENT DOCUMENTS 178746 4/1986 European Pat. Off. .
480663 4/1992 European Pat. Off. .
4107094 9/1992 Germany .

*Primary Examiner*—Robert J. Warden
*Assistant Examiner*—N. Bhat
*Attorney, Agent, or Firm*—Loeb and Loeb

[57] ABSTRACT

An electrostatic spraying machine for coating product comprises a hollow insulative material beam disposed horizontally over objects to be coated and carrying at least one coating product sprayer. The beam encloses a plurality of coating product supply hoses for the sprayer(s). The interior of the hollow beam is divided longitudinally into at least two conduits separated by a common wall.

18 Claims, 3 Drawing Sheets

ELECTROSTATIC SPRAYING MACHINE FOR COATING PRODUCTS

BACKGROUND OF THE INVENTION

1. Field of the Invention

The invention concerns a machine for electrostatic spraying of coating products onto objects such as automobile vehicle bodies.

2. Description of the Prior Art

On a production line the bodies are moved by a conveyor and the coating product spraying machine comprises a gantry supporting a horizontal beam perpendicular to the path of the bodies and this beam carries one or more coating product sprayers, which are of the rotary type, for example. These machines, which are sometimes referred to as overhead machines, are of primary importance for the coating of the objects to be painted, especially if the objects have many substantially horizontal surfaces like the trunk, the roof and the hood of an automobile vehicle body.

The complexity of these machines stems mainly from the feeding of the coating product and air to the sprayers when these can move over large distances. Long hoses are required and the location of control units in restricted spaces is often difficult. Additionally, the sprayers being at the high voltage, it is necessary to insulate them from any object at ground potential. Prior art electrostatic spraying machines usually include three sprayers carried by a metal beam and fed with coating product from one or more coating product change units located near the machine and supplied with voltage from one or more voltage increaser units (high-tension units) also located near the machine.

SUMMARY OF THE INVENTION

The invention consists in an electrostatic spraying machine for coating product including a hollow insulative beam disposed horizontally above objects to be coated and carrying at least one coating product sprayer.

This construction of the hollow beam of the electrostatic spraying machine enables insulation of the sprayers at the high voltage from their supply systems. By virtue of the invention it is possible to use one or more coating product change units on the beam itself, even though these units must be grounded at all times, especially if they include electrical or electronic control systems. Furthermore, for reasons concerning the protection of the environment, electrostatic spraying installations are increasingly using water-soluble paint; an important characteristic of water-based paints is that they are electrically conductive. When these paints are used it is essential to insulate the coating product change unit and its many supply hoses from the high voltage as otherwise the paint will cause a short-circuit. The invention provides for such insulation in combination with an electric and fluidic isolator and an intermediate storage tank located between the coating product change unit and the sprayer.

The geometry of the cross-section of the hollow beam provides for definition of a plurality of conduits whose contents can be at different potentials. It can also provide sufficiently long creepage distances between the grounded parts and the parts at the high voltage. Finally, the insulative plastics material used, an epoxy resin, for example, substantially reduces the weight of the beam, which is advantageous with regard to the rating of the beam drive systems and motors and for transportation and installation of the beam.

The invention is described further and other advantages of the invention emerge in the following description of various embodiments of an electrostatic spraying machine for coating product in accordance with the invention given by way of example only and with reference to the appended drawings.

DETAILED DESCRIPTION OF THE PREFERRED EMBODIMENTS

Figure 1:
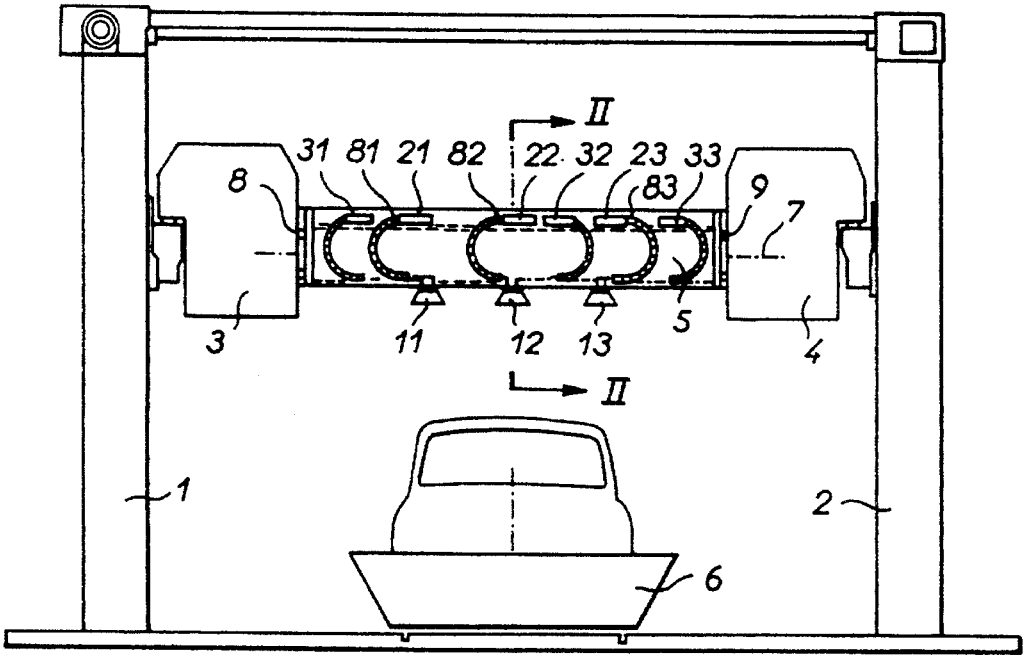
FIG. 1 is an elevation view of an electrostatic spraying machine for coating product in accordance with the invention.

The electrostatic spraying machine for coating product in FIG. 1 essentially comprises two columns 1 and 2, two carriages 3 and 4, and a hollow beam 5 adapted to move above objects, automobile bodies in this example, carried by a conveyor 6. The two carriages 3 and 4 move vertically along rails on the columns 1 and 2, in the known manner. The beam 5 can rotate about its horizontal axis 7, shown in chain-dotted line, in two bearings 8 and 9 providing its mechanical coupling to the carriages 3 and 4, respectively. Three sprayers 11, 12 and 13 supplied by three coating product change units 21, 22 and 23 and by three voltage increaser units 31, 32 and 33 are adapted to move parallel to the axis 7 over a travel of about 100 mm.

They can therefore be scanned and be adjusted in the widthwise direction as necessary to obtain a uniform surface state. Three electrical flowmeters 81, 82, 83 on the output side of the respective coating product change blocks 21 to 23 monitor correct operation of the sprayers 11 to 13.

Figure 2:
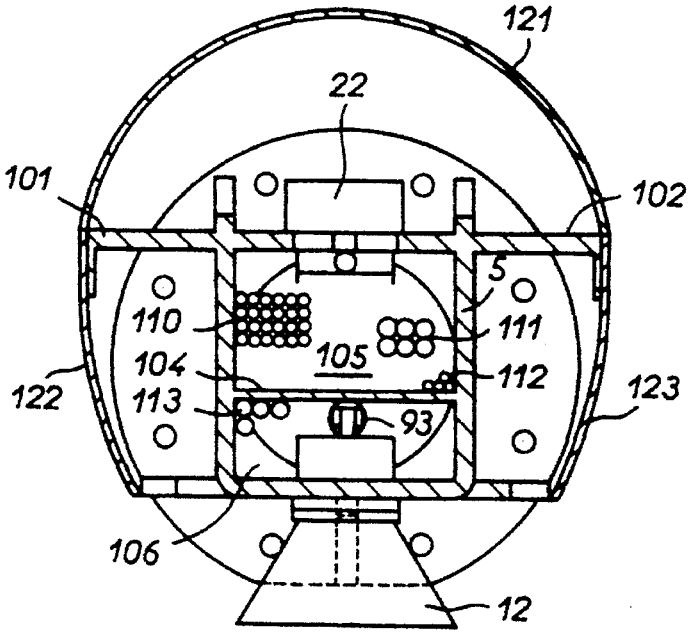
FIG. 2 is a cross-section view on the line II—II in FIG. 1 to a larger scale.

FIG. 2 shows the geometry of the cross-section of the hollow beam 5. The beam is molded in one piece from epoxy resin. It has a generally square cross-section with stiffener ribs 101 and 102 coplanar with its top surface. The ribs 101 and 102 guarantee high stiffness against torsion and bending of the hollow beam 5. According to an important feature of the invention the internal space of the hollow beam 5 is divided longitudinally by a wall 104 into two conduits 105 and 106. The unitary construction of the hollow beam 5 eliminates the risk of creepage at the junction of the wall 104 with the sides of the hollow beam.

The top conduit 105 can accommodate all the hoses 110 supplying coating product and the hoses 111 supplying rinsing product connected to the coating product change units. In the conventional case of a unit for 24 colors, there are 24 inlets and 24 return lines for coating product per coating product change unit. In addition to the rinsing product hoses, it is necessary to accommodate 144 coating product hoses. As these hoses, which may be grouped into bundles, are accommodated in a single conduit, maintenance is simplified because no motor, flowmeter or reinforcing member impedes the conduit 105. Electrical power is supplied to the voltage increaser units 31 to 33 and the flowmeters 81 to 83 by low-voltage electric cables 112 also housed in the conduit 105.

The bottom conduit 106 houses the hoses 113 supplying air to the sprayers 11 to 13 and the coating product change units 21 to 23. The separation of the compressed air supply and coating product supply arrangements is beneficial in maintenance terms.

An insulative plastics material cover comprises three longitudinal parts 121, 122 and 123 fixed to the ends of the ribs 101 and 102 and at the bottom of the hollow beam 5. It protects the components 21 to 23, 31 to 33 and 81 to 83 against the paint backflow and against the electrostatic field. It also improves the aerodynamics of the beam in order to minimize disturbance of spray booth ventilation. It is also made from epoxy resin.

The sprayers 11 to 13 are at the high voltage whereas the hoses 110 and 111 are grounded and the cables 112 are at a much lower voltage. Creepage of the high voltage must therefore be prevented. Here the geometry of the beam cross-section is particularly advantageous. The shortest creepage distance between the sprayers and the parts that are grounded or at the low voltage is perpendicular to the axis 7 and follows the exterior of the hollow beam 5; in particular, it passes around the ends of the ribs 101 and 102, which guarantees a length sufficient to prevent creepage of the high voltage. Also, it is easy to adapt this length by lengthening to a greater or lesser degree the ribs 101 and 102 which are in this creepage distance twice over.

Figure 3:
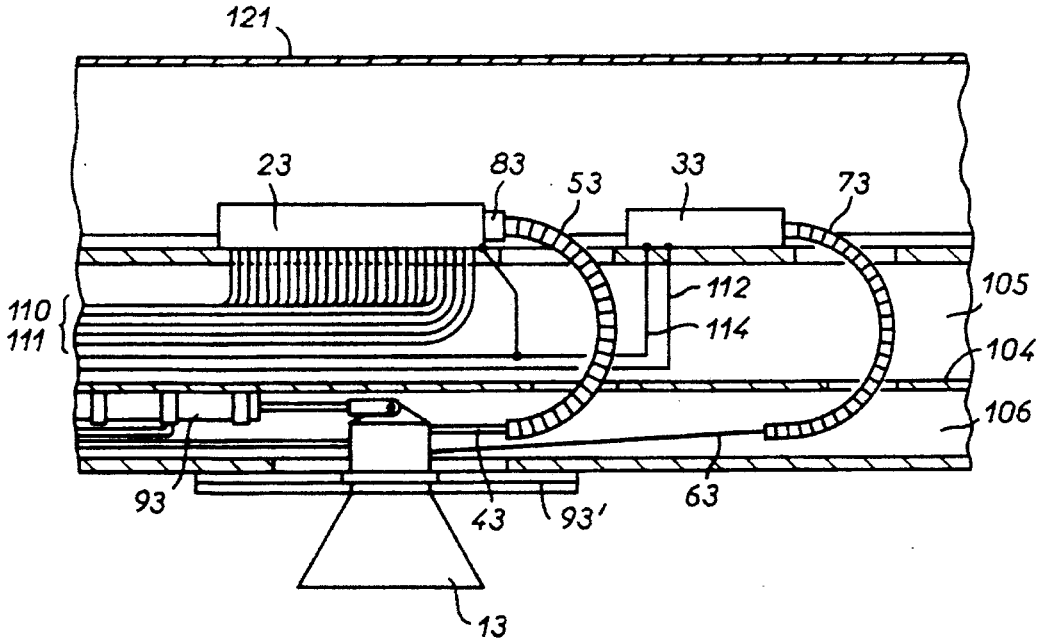
FIG. 3 is a view of part of a first embodiment of electrostatic spraying machine in accordance with the invention, shown to a larger scale.

The description continues with reference to FIG. 3 showing the sprayer 13 and the coating product and high voltage supply systems thereof to a larger scale. The hose 43 connecting the coating product change unit 23 to the sprayer 13 is a flexible hose housed in an insulative flexible support 53 enabling the end of the hose 43 to follow horizontal movement of the sprayer 13. The support 53 extends through an opening between the two conduits 105 and 106. The hose 43 is less than one meter long, which minimizes losses each time the coating product is changed. The high tension cable 63 connecting the voltage increaser unit 33 to the sprayer is likewise housed in a support 73. The flowmeter 83 is disposed near the sprayer and on the outlet side of the coating product change unit, to guarantee that the information it supplies is accurate. A ground wire 114 grounds the coating product change unit 23 and the supply return connection of the high tension unit 33. It is common to the three sprayers. A pneumatic cylinder 93 and a guide 93' displace the sprayer 13 horizontally. The cylinder 93 is accommodated in the conduit 106; it is supplied with compressed air by some of the hoses 113 which are themselves housed in the conduit 106.

The coating product change unit 23 and the voltage increaser unit 33 are on top of the hollow beam 5; they are under the part of the cover 121 which is the only part that needs to be removed or opened to carry out maintenance operations; the coating product change unit 23 and the voltage increaser unit 33 are therefore of particularly easy access.

A construction similar to that just described with reference to FIG. 2 is used to supply the sprayers 11 and 12.

Note that the bottom conduit 106 supporting the sprayers 11 to 13 is crossed by and contains only air hoses 113 or pneumatic structural components 93. The only high tension components, namely the electrical cables 63 and the like, are located inside insulative supports.

Figure 4:
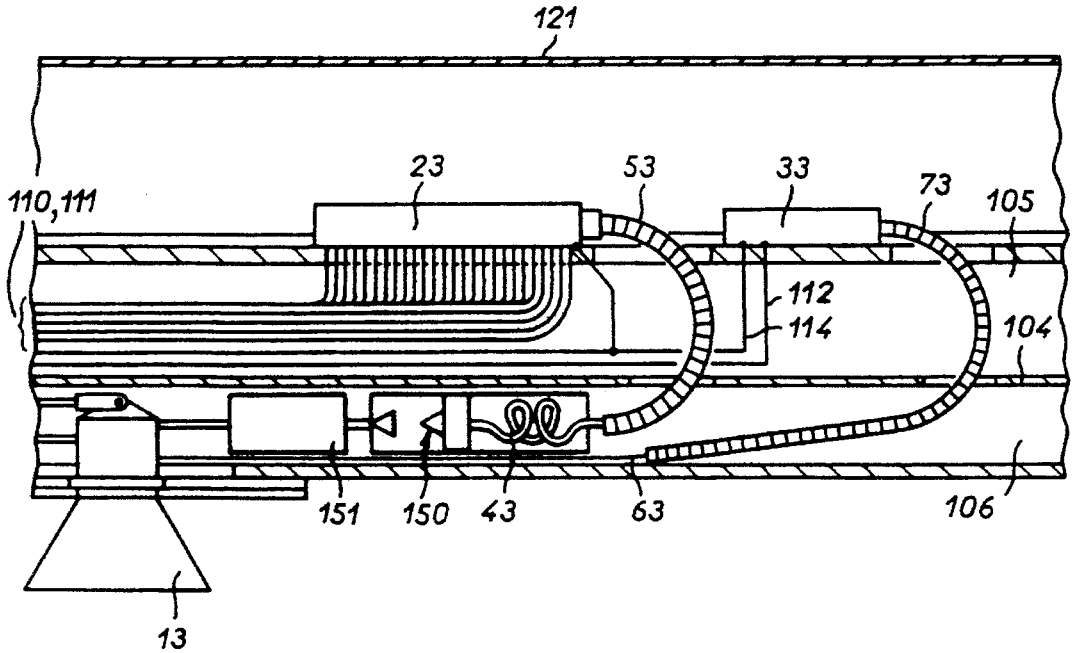
FIG. 4 is a view of part of a second embodiment of electrostatic spraying machine in accordance with the invention, shown to a larger scale.

If water-soluble paints are used, the FIG. 4 embodiment can be employed. Components which are identical to those of the FIG. 1 embodiment carry the same reference numbers. An electric and fluidic isolator 150 with quick-release connection means and an intermediate storage tank 151 are inserted between the hose 43 and the sprayer 13, near the latter in the conduit 106. In the coating phase the isolator is open and the high tension applied to the sprayer 13 cannot creep to the coating product change unit 23. When it is necessary to fill the intermediate storage tank 151, during the interval between two objects to be coated, for example, the high tension is disconnected and the isolator 150 is closed, enabling transfer of the coating product from the coating product change unit to the intermediate storage tank 151.

Figure 5:
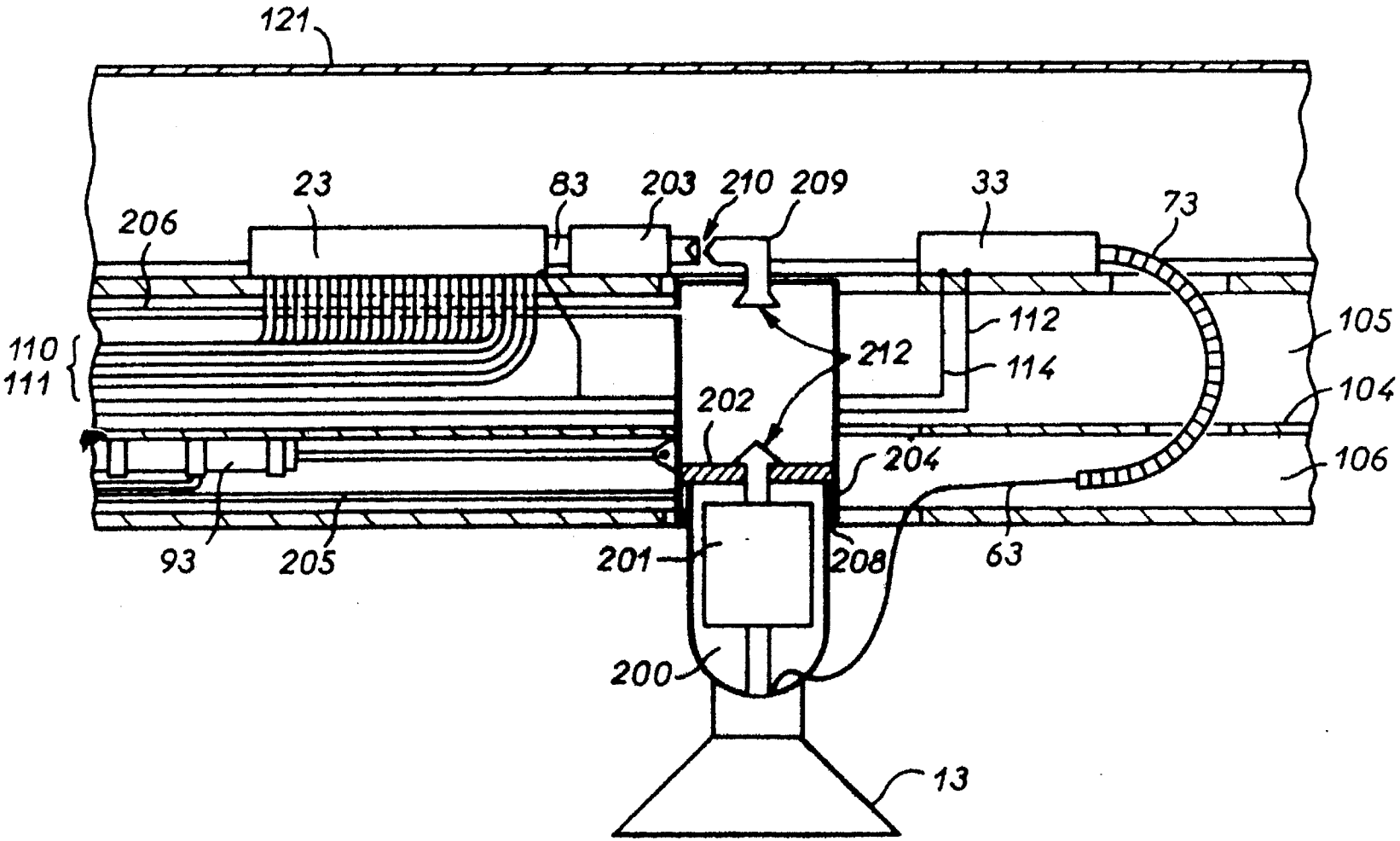
FIG. 5 is a view of part of a third embodiment of electrostatic spraying machine in accordance with the invention, shown to a larger scale.

The FIG. 5 embodiment can also be used in the case of conductive paint. Components which are identical to those of the FIG. 1 embodiment carry the same reference numbers. On the outlet side of the coating product change unit 23 and the flowmeter 83 is a cleaning-filling unit 203. The sprayer 13 is mounted at the end of an insulative support 200 containing a storage tank 201. The support is mobile in vertical translation, i.e. perpendicularly to the axis, between a bottom or coating position and a top or storage tank cleaning-filling position. To this end the support 200 is fastened to a piston 202 which moves in a cylinder 204 connected to air hoses 205 and 206. The hose 206 discharges into a closed top chamber of the cylinder 204 one wall of which consists of the piston 202. The hose 205 discharges into an annular bottom chamber defined between the piston 202, the cylinder 204, the support 200 and a sliding seal 208 between the cylinder and the support. The cylinder 204 and the objects that it contains are moved by a pneumatic cylinder 93 parallel to the axis 7 to scan the sprayer 13. A right-angle connector 209 is fitted at the top of the cylinder 204. First quick-release connection means 210 are provided between the cleaning-filling unit 203 and the connector 209. They are actuated by the cylinder 93. Second quick-release connection means 212 are provided between the connector 209 and the inlet of the storage tank 201 fastened to the piston 202. The cable 63 is connected to the sprayer 13.

Operation is as follows.

In the spraying phase the support is at the bottom position; the high tension can be applied to the sprayer 13 by the cable 63 without danger of return to earth or to the coating product change unit because the distance between the piston 202 and the cleaning-filling unit 203 is sufficient to provide the necessary electrical insulation. When it is necessary to clean the storage tank 201 and the sprayer 13 and to fill the storage tank 201 the high tension is disconnected and the cylinder 204 is moved parallel to the axis 7 by the cylinder 93 to close the connection means 210 and to connect to the cleaning filling unit 203. The piston 202 is raised to close the connection means 212. This places the unit 203, the storage tank 201 and the sprayer 13 in communication for the cleaning and filling operations that are familiar to the person skilled in this art. This configuration is particularly advantageous as it enables the three sprayers 11 to 13 carried by the hollow beam 5 to be located at different and variable heights. In particular, when coating the rear deck of a utility vehicle, it is advisable to raise the two outside sprayers 11 and 13 when they pass over wheels at the sides of the vehicle whereas the central sprayer 12 must be nearer the deck to achieve a good surface state.

The above description concerns a liquid coating product installation but the invention is equally applicable to a powder coating product.

There is claimed:

1. Electrostatic spraying machine including a gantry for coating objects, said machine comprising: a horizontal beam consisting of electrical insulating material extending above a path of travel for the objects, said beam being hollow; and at least one coating product sprayer and connected to receive coating product conveyed along said beam.

2. Spraying machine according to claim 1 wherein said beam encloses a plurality of coating product supply hoses for the sprayer or each sprayer.

3. Spraying machine according to claim 1 wherein the interior of said hollow beam is divided longitudinally into at least two conduits separated by a common wall.

4. Spraying machine according to claim 3 wherein said beam carries at least one coating product change unit connected to said at least one sprayer by a flexible hose section passing through an opening between said two conduits.

5. Spraying machine according to claim 3 wherein said beam carries at least one voltage increaser unit connected to said at least one sprayer by an insulative electrical cable passing through an opening between said two conduits.

6. Spraying machine according to claim 3 comprising a plurality of sprayers spaced along said beam, at least one of said sprayers being mobile in the longitudinal direction of said beam and wherein said at least one of said sprayers is operated by pneumatic cylinders accommodated in a bottom conduit which supports said sprayers.

7. Spraying machine according to claim 3 for application of electrically conductive coating products comprising insulating means including at least one electric and fluidic isolator and an intermediate storage tank inserted between a coating product change unit and said sprayer 8. Spraying machine according to claim 7 wherein said sprayer is disposed at the bottom end of an insulative support mobile vertically between a top connector and intermediate storage tank cleaning and filling position and a bottom operating position.

9. Spraying machine according to claim 8 comprising a plurality of sprayers which are adjustable in height independently of each other.

10. Spraying machine according to claim 3 wherein said beam has a substantially square or rectangular cross-section.

11. Spraying machine according to claim 10 wherein said beam has external stiffener ribs extending over the major part of its length, said ribs extending the electrical creepage distance between said sprayer and the first conduit housing grounded electrical parts.

12. Spraying machine according to claim 3 comprising: a plurality of sprayers spaced along said beam, at least one of said sprayers being mobile in the longitudinal direction of said beam; a flexible hose section for supplying a coating product to said at least one of said sprayers; and a deformable insulative support in which said flexible hose section is housed.

13. Spraying machine according to claim 3 comprising: a plurality of sprayers spaced along said beam, at least one of said sprayers being mobile in the longitudinal direction of said beam; an insulated electrical cable for supplying a coating product to said at least one of said sprayers; and a deformable insulative support in which said insulated electrical cable is housed.

14. Spraying machine according to claim 1 wherein said beam is surrounded by an aerodynamically shaped longitudinal cover.

15. Spraying machine according to claim 1 wherein said beam is a one-piece molded structure.

16. Spraying machine according to claim 15 wherein said beam is composed of a molded epoxy resin.

17. Electrostatic spraying machine forming a gantry for coating objects, said machine comprising: a horizontal beam consisting of electrical insulating material extending above a path of travel for the objects, said beam having a hollow interior and including a common wall which divides the hollow interior of said beam into a bottom conduit and a top conduit above said bottom conduit; at least one coating product sprayer carried by said beam and separated from said top conduit by said common wall; at least one coating product supply line housed in said top conduit; and means connecting said at least one coating product supply line to said at least one sprayer for supplying coating product to said at least one sprayer.

18. Spraying machine according to claim 17 further comprising at least one compressed air supply line housed in said bottom conduit and connected to said at least one sprayer for supplying compressed air to said at least one sprayer.

* * * * *